US005626091A

United States Patent [19]

Kobayashi

[11] Patent Number: 5,626,091

[45] Date of Patent: May 6, 1997

[54] SYSTEM FOR SUPPLYING AND SETTING MATERIALS IN A CONDITION TO BE SEWN BY A SEWING MACHINE

[75] Inventor: Yukihito Kobayashi, Akishima, Japan

[73] Assignee: Tachi-S Co., Ltd., Tokyo, Japan

[21] Appl. No.: 542,132

[22] Filed: Oct. 12, 1995

[51] Int. Cl.[6] ..... D05B 21/00

[52] U.S. Cl. ..... 112/470.07; 112/306; 112/320; 112/475.05; 271/267

[58] Field of Search ..... 112/470.14, 470.06, 112/470.07, 470.04, 475.07, 306, 153, 320; 271/3.01, 3.08, 227, 228, 234, 236, 239, 248, 264, 267, 268

[56] References Cited

U.S. PATENT DOCUMENTS 4,899,674 2/1990 Kawasaki .
4,899,675 2/1990 Kawasaki .
4,913,071 4/1990 Kawasaki .

FOREIGN PATENT DOCUMENTS 54-72966 5/1979 Japan .

*Primary Examiner*—Peter Nerbun
*Attorney, Agent, or Firm*—Browdy and Neimark

[57] ABSTRACT

A system for supplying and setting two separate base materials in a neat condition ready to be sewn by a sewing machine, which includes a supplying mechanism and a setting mechanism. A first one of the two base materials is automatically supplied by operation of the supplying mechanism to a movable guide plate movable toward the sewing machine, and then automatically set at a predetermined position thereon by operation of the setting mechanism, after which, another of the two base materials is likewise automatically set and juxtaposed on the thus-set first base material. The supplying mechanism includes a robot-hand unit for catching one of the two base materials and a transfer element for transferring the robot-hand unit to the movable guide plate. The setting mechanism includes setting elements for bringing both two base materials to the foregoing predetermined position so that they may be set in a neatly juxtaposed condition, and a partition plate for partitioning the two base materials from each other at that predetermined position.

17 Claims, 6 Drawing Sheets

SYSTEM FOR SUPPLYING AND SETTING MATERIALS IN A CONDITION TO BE SEWN BY A SEWING MACHINE

BACKGROUND OF INVENTION

1. Field of the invention

The present invention relates to a system for supplying and setting base materials (e.g. cloth or leather materials) in a condition to be sewn by a sewing machine. In particular, the invention is directed to a system for automatically supplying two separate base materials to a guide plate and setting them thereon in a juxtaposed condition, so that they may be ready to be sewn together by a sewing machine.

2. Description of Prior Art

There has been known various types of automated sewing machines or devices which are designed to automatically sew base materials together to form a surface covering member used as an outer surface of upholstery associated with a seat, such as an automotive seat. Examples of such sewing devices are found from the U.S. Pat. Nos. 4,899,674, 4,899,675, and 4,913,071 which commonly include a movable guide plate having rollers, the movable guide plate being movable, via the rollers, on a table of a sewing machine, to thereby permit base materials placed on that plate to be fed toward the sewing machine and sewn together by the same.

Particularly, with regard to an automated sewing device disclosed in the Japanese Laid-Open Utility Model Pub. No. 54-72966, two separate base materials are to be piled up upon a movable guide plate which is movable on a table of sewing machine via rollers, and respective lateral ends of the base materials are automatically fed to and sewn together by the sewing machine.

Hitherto, in any of those known sewing devices, two separate base materials are inevitably stored in a separate section distant from the device and therefore they need to be brought by the hands of an operator to the movable guide plate and further need to be set in a neatly juxtaposed condition by the same operator's hands for precise sewing by the sewing machine. Thus, a troublesome aspect has remained unsolved in operating the device, hence giving a rise to demand for a substantial full automated system in this particular point of the art.

SUMMARY OF THE INVENTION

In view of the above-stated shortcomings, it is thus a primary purpose of the present invention to provide an improved system which provides for automatically supplying and setting two separate base materials in a neat condition ready to be sewn by a sewing machine.

In order to attain such purpose, in accordance with the present invention, there is basically provided a system comprising:

- a table on which said sewing machine is mounted;
- a movable guide means which is slidably mounted on the table;
- a supplying mechanism for supplying the two separate base materials to the movable guide means, which supplying mechanism is provided at said table and includes:
  - a first storage means in which a plurality of one of the two base materials are stored in a piled-up manner;
  - a second storage means in which a plurality of another of the two base materials are stored in a piled-up manner;

and

- a robot-hand means displaceable between a selected one of the first and second storage means and the movable guide means, the robot-hand means including a pair of catching means for releasably engaging and catching a selected one of the two base materials and a pair of pressing means for applying a pressure to such selected one of two base materials;

and

- a setting mechanism for setting the two separate base materials and juxtaposing them together at a predetermined position upon the movable guide means, which setting mechanism includes:
  - a setting means arranged at and adjacent the movable guide means, the setting means being operable to act on the two base materials which are supplied to and juxtaposed on the movable guide means by means of the supplying mechanism, such that both two separate base materials may be neatly set at the predetermined position on the movable guide means;
  - a partition means extendable over the movable guide means and retractable therefrom, an arrangement of the same partition means being such as to partition one of the two separate base materials which is directly placed by the supplying mechanism on the movable guide means, from another of the two separate base materials which is to be juxtaposed on the thus-placed one of the two base materials by the supplying mechanism; and
  - a retaining means for pressingly retaining that another of said two separate base materials which is juxtaposed on and partitioned via the partition means, from the same another of two separate base materials.

As one preferred embodiment, the robot-hand means may include a horizontal frame, on which are provided those paired catching and pressing means, and a vertical cylinder means provided on the horizontal frame, wherein the vertical cylinder is operable to cause vertical movement of the robot-hand means per se with respect to the table.

Preferably, those two catching means each may include a plurality of needle means to be piercingly engaged with a surface of either of the two separate base materials, and the robot-hand means may include a pair of horizontal cylinders each being operable to cause the respective two catching means to be moved in a horizontal direction toward and away from each other, with both two catching means and two sets of the plural needle means respectively thereof being disposed between the two pressing means.

Preferably, the partition means may comprise a partition plate and a cylinder means for extending and retracting the partition plate in a direction toward and away from the movable guide means, whereby the above-mentioned one of the two separate base materials directly placed on the movable guide means can be partitioned by the partition plate from the above-mentioned another of the two base materials which is to be juxtaposed on the thus-placed base material.

As another aspect of the invention, it may be so arranged that the two separate base materials are identical in shape to each other and have their respective common ends to be sewn together, with each of the two materials being of a three-layer lamination structure comprising a top cover layer with a fuzzy surface, a foam wadding layer, and a back wadding cover layer, in this order, and that one of those two identical materials is stored in a plural form within the first storage means, with the top cover layer thereof exposed upwardly, while by contrast, another of them is turned over and stored in a plural from, with the back wadding cover layer thereof exposed upwardly, within the second storage means. Also, the setting means may comprise a stationary setting means and a movable setting means, and the same stationary and movable setting means may be so arranged that, when in operation, they cooperate with each other to provide setting surfaces generally conforming to an outer contour of the two identical base materials, with the stationary setting means serving to receive and set the foregoing common ends of two base materials relative to the predetermined position.

Other specific various structural features and advantages of the present invention will become apparent from reading of the descriptions hereinafter, with reference to the annexed drawings.

DETAILED DESCRIPTION OF PREFERRED EMBODIMENTS OF THE INVENTION

Figure 1:
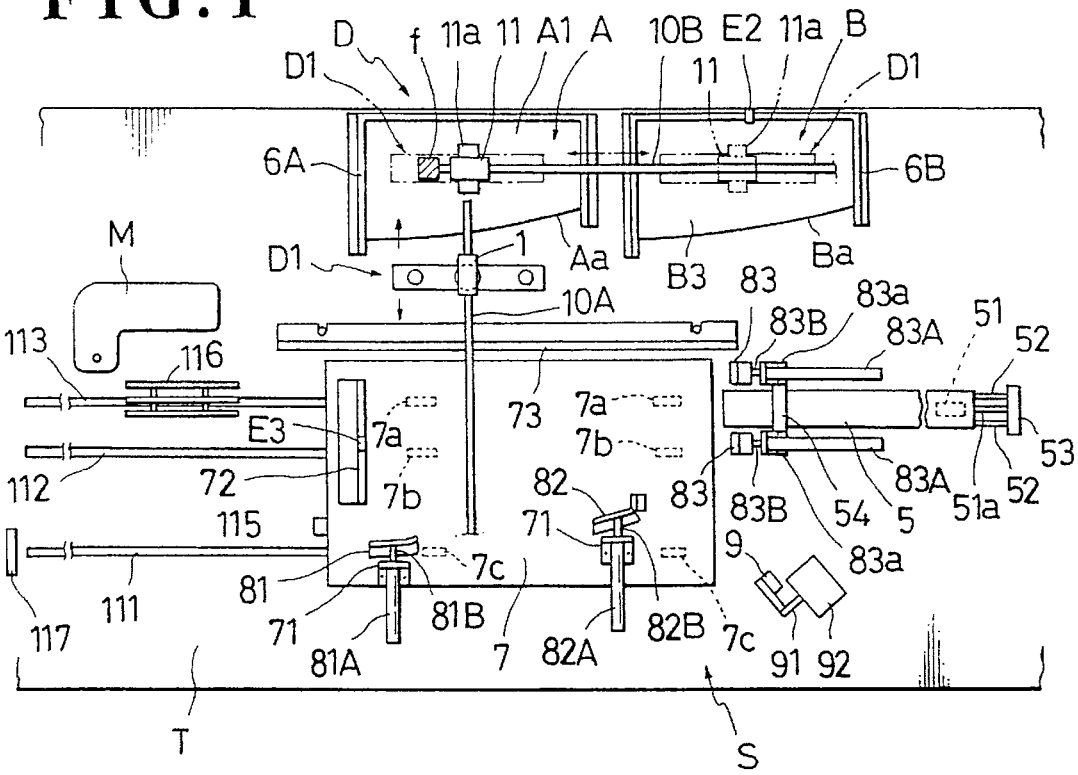
FIG. 1 is a schematic, partly broken plan view of a system, in accordance with the present invention, for supplying and setting two separate base materials.
Figure 2:
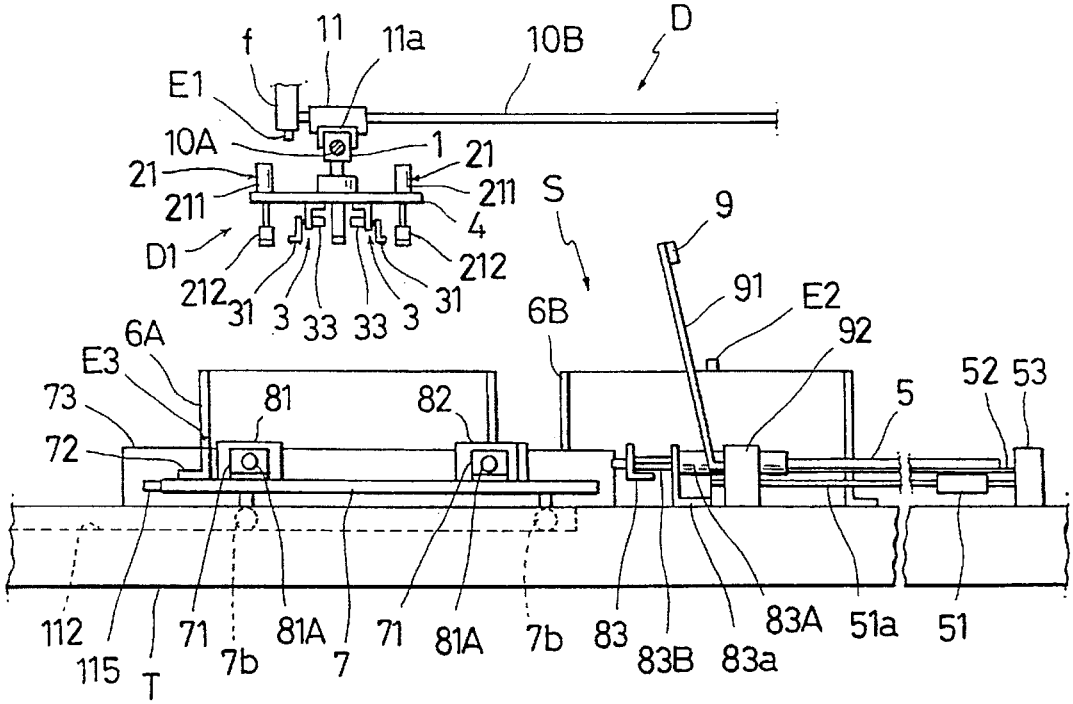
FIG. 2 is a schematic, partly broken front view of the system.

Referring firstly to FIGS. 1 and 2, there is generally shown a whole view of a system in accordance with the present invention, which is designed to automatically supply and set first and second separate base materials (A)(B) in a condition to be sewn together by a sewing machine (M) provided in combination therewith.

Figure 7:
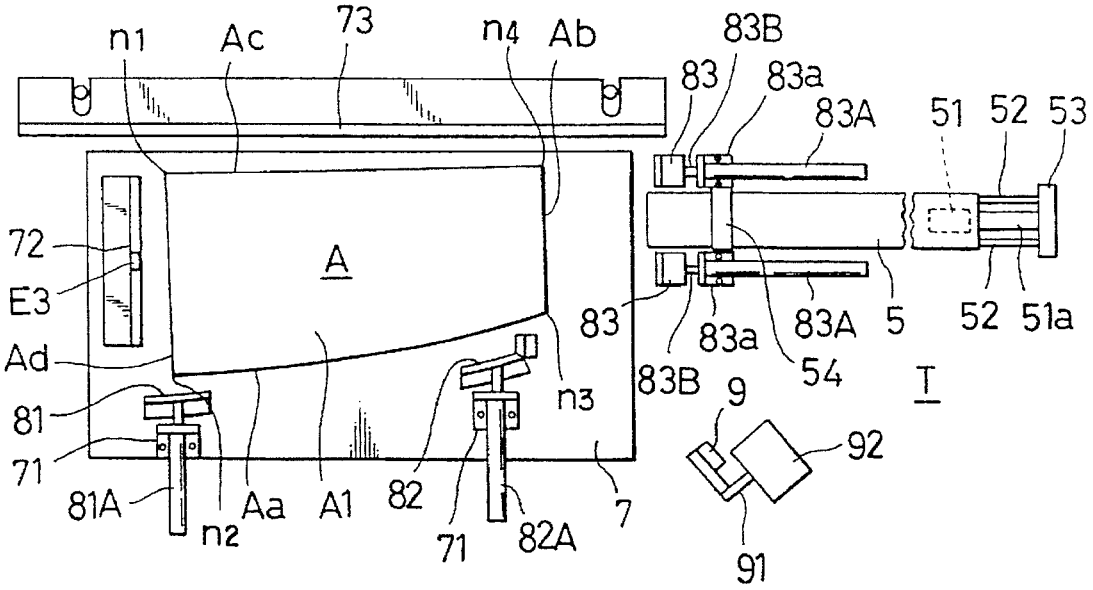
FIG. 7 is a schematic plan view of a setting mechanism in the system of the present invention, which shows the first base material being roughly placed on the movable guide plate.
Figure 12:
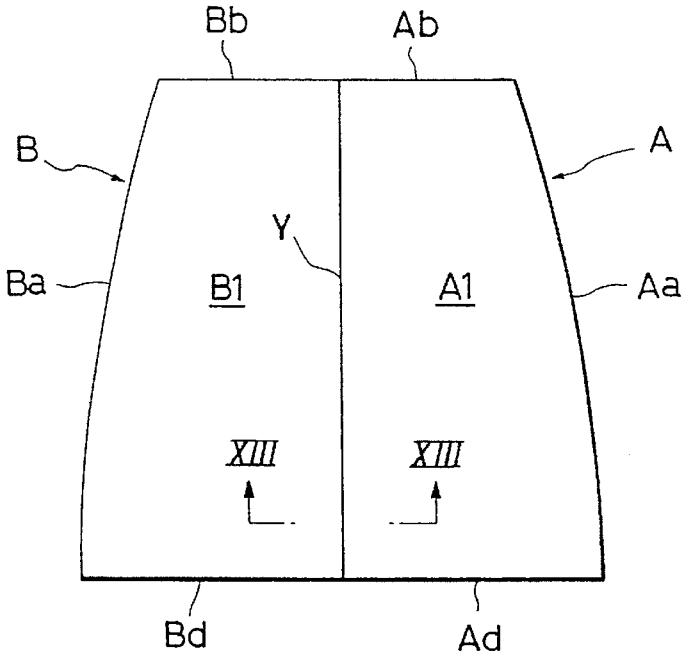
FIG. 12 is a plan view of a resulting covering product to be obtained by the system of the present invention.
Figure 13:
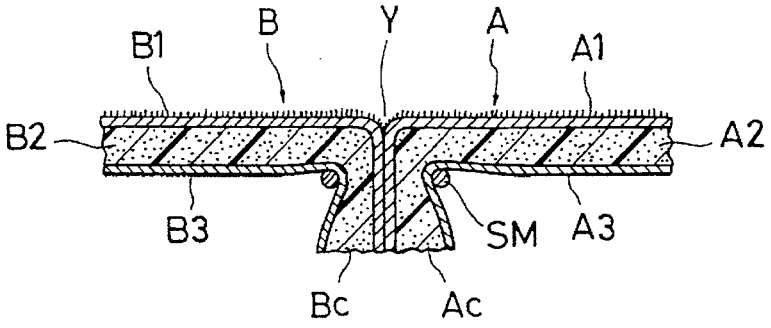
FIG. 13 is a partial cross-sectional view taken along the line XIII—XIII in FIG. 12.

The first and second base materials (A)(B) to be used in the present system are both formed in an identical shape, as can be seen in FIGS. 1 and 11 to 13. As best shown in FIGS. 7, 12 and 13, the first base material (A) has an upper rectilinear end (Ab), a curved lateral end (Aa), a rectilinear lateral end (Ac) and a lower rectilinear end (Ad), and likewise, the second base material (B) has an upper rectilinear end (Bb), curved lateral end (Ba), a rectilinear lateral end (Bc) and a lower rectilinear end (Bd). Each of those two materials (A)(B) is of a three-layer lamination structure in which a top cover layer (A1, B1) with a fuzzy outer surface, a slab foam wadding layer (A2, B2), and a back wadding cover layer (A3, B3) with an unevenly textured outer surface are laminated in this order as in FIG. 11. In general, both top cover layer (A1,B1) and back wadding cover layer (A3, B3) are in a fuzzy or unevenly textured condition since they are formed from a woven fabric, a stitch-like surfaced synthetic resin material, or the like. For the purpose of the present invention, it is preferable that the top cover layer (A1, B1) be formed from a woven fabric and the back wadding cover layer (A3,B3) from a stitch-like or mesh-like surfaced synthetic resin material.

The two base materials (A)(B) are so preformed that they may be sewn together at and along their respective rectilinear ends (Ac)(Bc) and expanded symmetrically relative thereto as shown in FIGS. 12 and 13, assuming thus a predetermined shape of seat back or seat cushion of a seat (e.g. an automotive seat).

The present system is arranged at a table (T) of the sewing machine (M), comprising, basically, a supplying mechanism (D) for supplying two separate base materials (A)(B) to a given setting point, and a setting mechanism (S) provided at that setting point, which operates to set the base materials (A)(B) in a neatly juxtaposed condition ready to be sewn by the sewing machine (M).

The supplying mechanism (D) is essentially composed of a pair of first and second storage booths (6A)(6B), each being for storing therein a plurality of the first and second base materials (A)(B), respectively, and a robot-hand unit (D1) displaceable between those storage booths (6A)(6B) and the foregoing setting mechanism (S). As will be described later, the robot-hand unit (D1) operates to take out the first and second base materials (A)(B) one by one from their respective storage booths (6A)(6B) and supply them to a movable guide plate (7) of the setting mechanism (S) so that they are juxtaposed with each other thereon.

Both first and second storage booths (6A)(6B) are shown in FIG. 1 to be disposed side by side along and adjacent to one side end of the table (T).

Figure 3:
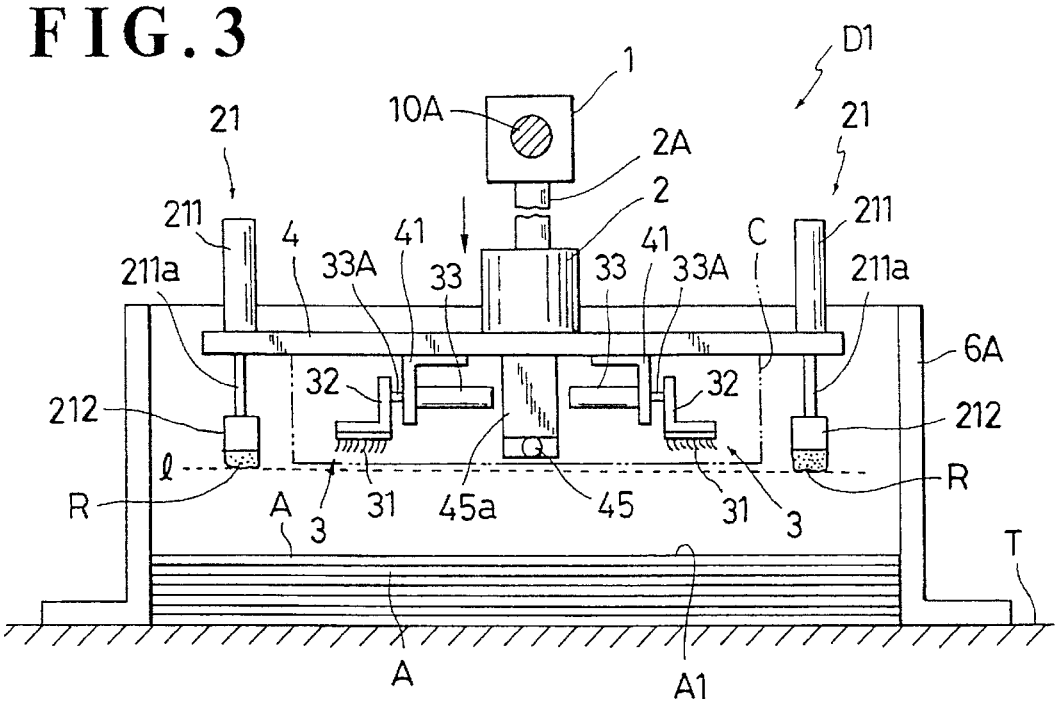
FIG. 3 is a schematic view of a robot-hand unit, a part of a supplying mechanism, showing explanatorily the same to be positioned at a first storage booth.

The body of the robot-hand unit (D1), as shown in FIGS. 2 and 3, comprises: a base frame (4); a vertical cylinder (2) fixed midway on an upper surface of the base frame (4); a pair of spaced-apart pressing devices (21)(21) which are provided at the base frame (4) such as to be disposed on the opposite sides of the first vertical cylinder (2); a photosensor (45) connected via a downwardly extending bracket (45*a*) to the central part of the lower surface of base frame (4); and a pair of spaced-apart catching devices (3)(3) which are so provided at the lower surface of base frame (4) as to be situated on the opposite sides of the bracket (45*a*).

The robot-hand unit (D1) further comprises a transfer mechanism (1, 10A, 11, 10B) for transferring the above-constructed body between the two storage booths (6A)(6B)

and the setting mechanism (S). The transfer mechanism may be based on a so-called "rod-less cylinder" wherein a moving block member (1 or 11) is moved on and along a tubular guide bar member (10A or 10B) under a controlled magnetic force. Although not shown, in brief, one array of plural permanent magnets are disposed in one of the moving block member and tubular guide bar member, while another array of plural electromagnetic pieces are disposed in another of them, with such an arrangement that, through a proper electronic control elements, a repulsive force produced between those two different arrays of magnetic substances may be controlled to cause fore-and-aft movement of the moving block member along the tubular block member. In the embodiment shown in FIGS. 1 and 2, as one exemplary mode, a first transfer element of rod-less cylinder type may be provided in a manner extending above the first storage booth (6A) and the guide plate (7) of setting mechanism (S), the first transfer element comprising a first tubular bar member (10A) and a first moving block member (1) slidably fitted thereon. Also, a second transfer element of rod-less cylinder type may be so provided as to extend at a right angle with the first transfer element in a direction from the first storage booth (6A) to the second storage booth (6B), which second transfer element comprises a second tubular bar member (10B) and a second moving block member (11) slidably fitted thereon. The second moving block member (11) has an engagement portion (11*a*) in which the first moving block member (1) is to be engaged. Though not shown clearly, the second tubular bar member (10B) is supported by a support frame (f) disposed above the present system, and likewise supported is the first tubular bar member (10A) whose free end terminates at a point distant from one end of the latter bar member (10A), permitting the robot-hand unit to be transferred by the second moving member (11) along the second bar member (10B). This is however not limitative, but for example, the transfer mechanism may be constructed in a monorail manner, using one moving block member (i.e. at (1)) and one unitary L-shaped tubular bar member disposed like the foregoing first and second ones (10A)(10B), in which case, of course, a proper means may be provided for automatically maintaining the longitudinal body of robot-hand unit (D1) in parallel with both first and second storage booths (6A)(6B) as it is indicated from the solid line to both one-dot and two-dot chain lines in FIG. 1 when it is turned at a curved part of the L-shaped tubular bar member.

Referring to FIG. 3, specifically stated with regard to the robot-hand unit (D1), the vertical cylinder (2) has a cylinder rod (2A) connected to the first block member (1) associated with the first transfer mechanism stated above, so that the body of robot-hand unit (D1) may be raised and lowered with respect to the table (T) by operation of the vertical cylinder (2). The two pressing devices (21) each comprises a vertical pressing cylinder (211), a pressure piece (212) provided at the cylinder rod (211*a*) of the pressing cylinder (211), and an elastic member (R) (preferably made of an urethane foam) fixed at the lower end of the cylinder rod (211*a*). On the other hand, the two catching devices (3) each comprises a horizontal cylinder (33) and a catching member (32) having a plurality of catching needles (31). The catching member (32) is fixed to the cylinder rod (33A) of the horizontal cylinder (33). Hence, as will be elaborated, operating the paired cylinders (33) will cause the paired catching members (32) to be moved away from each other so as to slightly scratch or hookingly engage the fuzzy upper surface (A1) of first base material (A) or the unevenly textured back surface (B1) of second base material, by way of the paired sets of catching needles (31)(31), to thereby catch one sheet of the base material (A or B).

Preferably, those two sets of needles (31)(31) may be inclined outwardly in a direction opposite to each other, as shown, in order to attain a more positive engagement with the upper surface (A1) of first base material (A) or the back surface (B1) of second base material (B).

It is noted in this context that the downward surfaces of the foregoing paired elastic members (R)(R) are normally positioned at a level lower than the paired catching devices (3)(3) and photosensor (45) as indicated by (l) in FIG. 3, so that the base material (A or B) may be pressingly retained in advance by the elastic members (R)(R) before being detected by the photosensor (45) and contacted with the needles (31)(31) of the catching devices (3)(3). Preferably, in addition to the elastic members (R), a pair of another elastic members (C) of urethane foam may be fixed to the downward surface of the base frame (4) in a manner symmetrical relative to both catching devices (3) and photosensor (45), as indicated by the two-dot chain line in FIG. 3. This will insure to retain a wide area of the uppermost base material (A or B) against dislocation and creation of undesired creases thereon.

Figure 4:
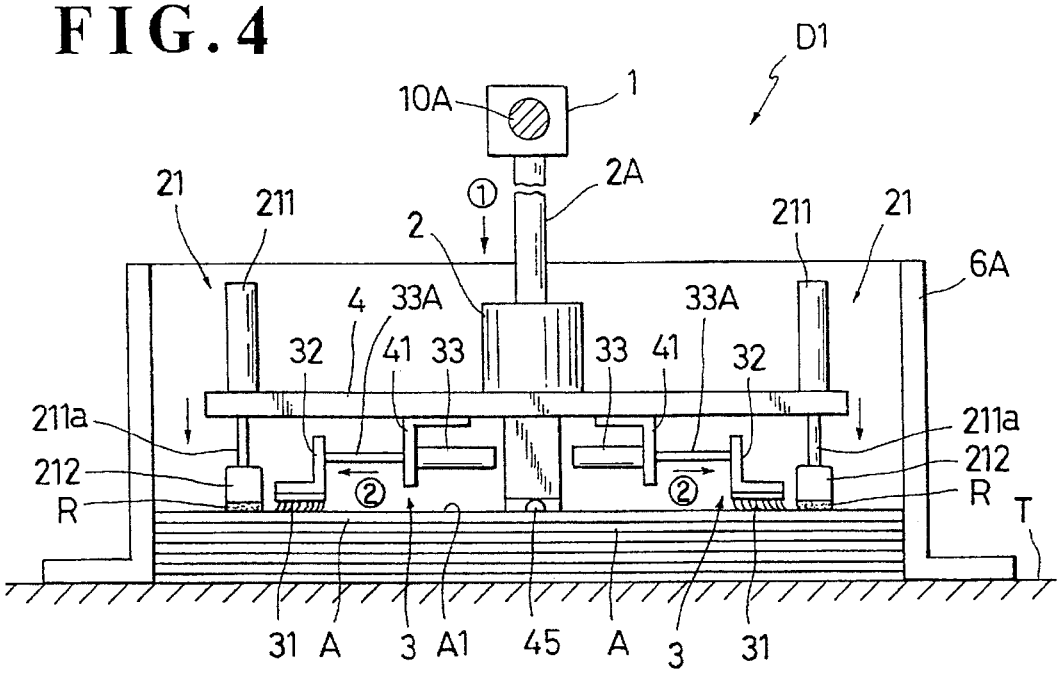
FIG. 4 is a schematic view of the robot-hand unit, showing explanatorily the same to be lowered to catch an uppermost one of first base materials piled up in the first storage booth.
Figure 5:
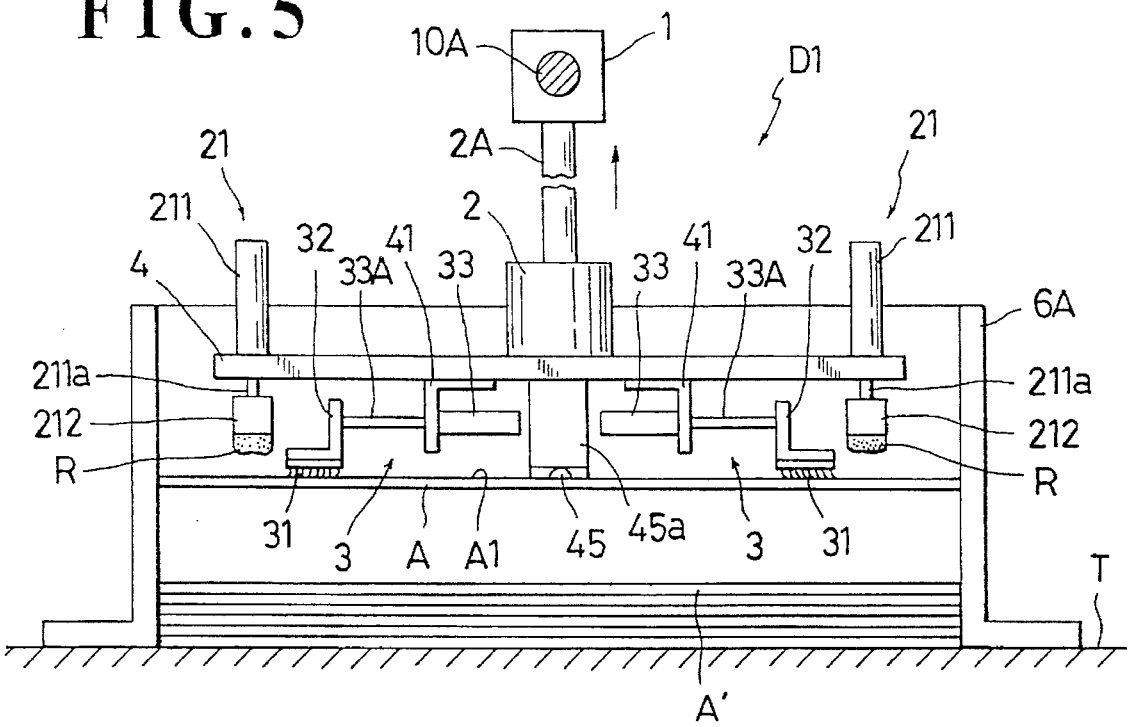
FIG. 5 is a schematic view of the robot-hand unit, showing explanatorily the same to be raised away from the piled-up first base materials, catching the uppermost one of them therefrom.

The photosensor (45) is so disposed in the unit (D1) as to detect the uppermost one of plural piled-up base materials (A or B) stored in the booth (6A or 6B) as can be seen from FIGS. 4 and 5.

Designations (E1)(E2) denote a first sensor for detecting the robot-hand unit (D1) to be positioned above the first storage booth (6A) and a second sensor for detecting the same unit (D1) to be positioned above the second storage booth (6B), respectively.

Designation (E3) denotes a third sensor for detecting the robot-hand unit (D1) to be positioned at a predetermined point above the movable guide plate (7) of setting mechanism (S).

Although not shown, the robot-hand unit (D1) includes a computerized control circuitry and associated electronic elements required to actuate all the mechanisms (1, 2, 3, 11, 21) in response to the detection of the sensors (E1, E2, E3) at each of the booths (6A)(6B) and guide plate (7).

Turning, now, to review of FIGS. 1 and 2, the setting mechanism (S) is shown as being arranged on the table (T) along-side of the two storage booths (6A)(6B) and in the neighborhood of the sewing machine (M).

The setting mechanism (S) comprises: the movable guide plate (7) already mentioned above, which is provided with a three paired rollers (7*a*)(7*b*)(7*c*) at the reverse side thereof; three guide grooves (113)(112)(111) formed in the table (T), in which the tree paired rollers (7*a*)(7*b*)(7*c*) are respectively fitted in a rotatable manner, the guide grooves (112)(113)(111) extending towards and passing in front of the sewing machine (M); a first rectilinear stationary setting member (73) adjustably secured on the table (T), which is disposed between the two booths (6A)(6B) and movable guide plate (7), extending adjacently along one lateral end of the movable guide plate (7); a second rectilinear stationary setting member (72) fixed on the forward end portion of the guide plate (7), which second stationary setting member (72) extends at a right angle relative to the first setting member (73); a pair of spaced-apart first and second movable setting members (81)(82) mounted on another lateral end of the same guide plate (7) opposite to the foregoing one lateral end thereof, the first and second movable setting members (81)(82) being movable in a direction toward and away from the first stationary setting member (73); a pair of spaced-apart third movable setting members (83)(83) mounted on the table (T) adjacent to the backward end of the movable guide plate (7), the third movable setting members (83)(83) facing towards the second stationary setting member (72); and a slidable partition plate (5) which is so mounted on the table (T) as to be interposed between the two third movable setting members (83)(83).

In the setting mechanism (S), a retaining device (at 9) is further provided on the table (T) and disposed adjacent to the backward end of movable guide plate (7).

The movable guide plate (7) may be moved along the three rectilinear guide grooves (111)(112)(113) between the given setting point to which the base material (A or B) is to be brought by the robot unit (D1) and a sewing point where the sewing machine (M) is located. Through not shown, a hydraulic cylinder is provided to cause such movement of guide plate (7). Normally, the guide plate (7) is positioned at the setting point as in FIGS. 1 and 2. By operation of that not-shown cylinder, it may be moved therefrom, passing by the sewing machine (M), and automatically stopped and returned to such setting point, upon a microswitch (115) provided at the forward end thereof being depressed "on" by a stopper member (117) fixed on the table (117) as in FIG. 1.

The first stationary setting member (73) erects on the table (7) to a level higher than the flat plane of movable guide plate (7) and provides a laterally elongated setting surface along which the rectilinear lateral end (Ac or Bc) of base material (A or C) is to be set. This setting member (73) is of a length greater than the whole length of the guide plate (7) to insure setting that base material lateral end (Ac or Bc) in a stable position therealong. Further, the elongated surface of setting member (73) is formed so slippery and smoothly as to permit the rectilinear lateral end (Ac or Bc) of base material (A or B) to be slid well therealong with an extremely reduced friction.

On the movable guide plate (7), the second stationary setting member (72) is so disposed and elongated that a predetermined distance is given from its one lateral end to the first movable setting member (81), allowing the latter (81) to be moved towards the first stationary setting member (73) to the degree at which the rectilinear lateral end (Ac or Bc) of base material (A or B) is brought to abutment against the first stationary setting member (73), while the second corner portion (n2 or n'2) of base material (A or B) is set by the first movable setting member (81) and another lateral side of the second stationary setting member (72) adjacent thereto, as can be seen from FIGS. 7 an 8.

The first movable setting member (81) has a slightly curved surface conforming to a lower part of the curved lateral end (Aa or Ba) of base material (A or B) adjacent to the second corner portion (n2 or n'2) thereof. This setting member (81) is connected to the cylinder rod (818) of cylinder (81A) fixed via a bracket (71) to the guide plate (7), and arranged such as to be disposed at one lateral side of the guide plate (7) opposite to another lateral side of same adjacent the first stationary setting member (73), in a slidable contact thereupon. Thus, by operating the cylinder (81A), the first movable setting member (81) may be moved slidingly on the guide plate (7) to displace its curved surface toward and away from the vertical flat surface of the first stationary setting member (73). In this respect, it is important that the cylinder (81A) should be so positioned relative to the second stationary setting member (72) that operating the same cylinder (81) will bring its associated first movable setting member (81) to a joining or cooperative relation with the aforementioned one lateral end of second stationary setting member (72) to circumscribe and set the second corner portion (n2 or n'2) of base material (A or B) as can be seen in FIGS. 7 to 10.

The second movable setting member (82) has a surface of generally L-shaped cross-section conforming to the third corner portion (n3 or n'3) of base material (A or B). As shown, this second setting member (82) is connected to the cylinder rod (82B) of cylinder (82A) fixed via a bracket (71) to the guide plate (7), and disposed generally abreast with the first movable setting member (81) in a slidable contact on the guide plate (7). Thus, operating the cylinder (82A) causes the second movable setting member (82) to slidingly move on the guide plate (7) to displace its L-shaped surface towards and away from the first stationary setting member (73). In this respect, importantly the cylinder (82A) should be so positioned on the guide plate (7) that operation of the same cylinder (82A) will bring its associated second movable setting member (82) to a point for circumscribing and setting the third corner portion (n3 or n'3) of base material (A or B) as can be seen in FIGS. 7 to 10.

The paired third movable setting members (83)(83) each has a vertical flat surface to contact the upper rectilinear end (Ab or Bb) of base material (A or B). The setting members (83)(83) are each connected to the cylinder rod (83B) of cylinder (83A) fixed via a bracket (83*a*) on the table (T), such that they are disposed in the proximity of a side of the movable guide plate (7) opposite to another side of same where the second stationary setting member (72) lies. Further, those setting members (83)(83) are disposed on a level generally in registry with the flat upper surface of guide plate (7), so that they may be moved on the guide plate (7) in a sliding contact thereupon, to displace their vertical flat surfaces in a direction towards and away from the second stationary setting member (72).

Figure 8:
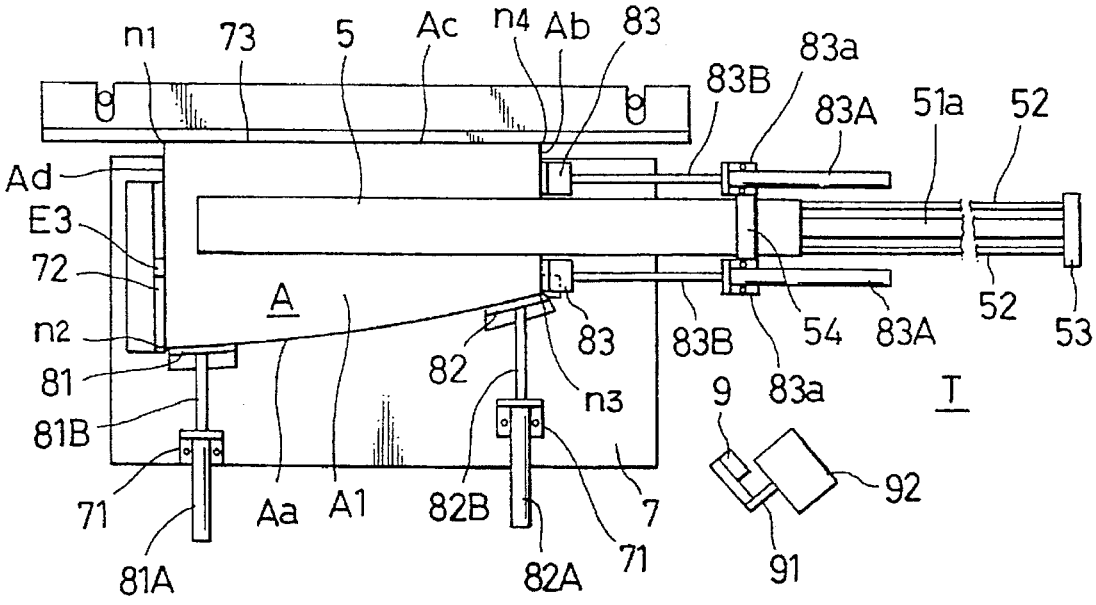
FIG. 8 is a schematic plan view of the setting mechanism, which shows the same to operate to set the first base material in place on the movable guide plate.

Interposed between those two setting members (83)(83) is the slidable partition plate (5), such that the forward end of the partition plate (5) is normally positioned apart from the guide plate (7) when not in operation. The partition plate (5) is slidingly moved on and along a pair of spaced-apart rail members (52)(52) by operation of a fore-and-aft moving drive element (51) of the previously explained rod-less cylinder type. The drive element (51), which is fixed to the reverse side of slidable partition plate (5), travels along a cylinder tube (51*a*) under a controlled magnetic force in the longitudinal direction thereof, to thereby extend the partition plate (5) above the guide plate (7) and withdraw it therefrom, in a direction toward and away from the second stationary setting member (72) (see FIGS. 7 to 10). As shown, the rail members (52) and cylinder tube (51*a*) are both fixed on the table (T) by means of two support brackets (53)(54). It is noted here that the partition plate (5) is disposed at a level above the two third movable setting members (83)(83) as understandable from FIG. 2. Namely, the partition plate (5) is disposed on a level apart from the upper surface of guide plate (7) at a distance slightly greater than the thickness of the first base material (A), so that, as will be explained later, the partition plate (5) may be extended over and along the first base material (A) set on the guide plate (7), for the purpose of partitioning the first base material (A) from the second base material (B) to be juxtaposed thereon (see FIG. 9). To serve that purpose well, the partition plate (5) is formed to have such a length that its forward end may reach a point adjacent to the second stationary setting member (72) as shown in FIG. 8 and formed from a metallic or hard synthetic resin material having very slippery surfaces which facilitate a smooth withdrawal of the plate (5) per se from between the juxtaposed two base materials (A)(B) at a final stage of setting operation to be described later.

In summary, the four setting means constructed by the first stationary setting member (73), second stationary setting member (72), paired movable setting members (81)(82) and paired movable setting members (83)(83) are arranged to surround the four sides of base material (A or B), so that, in operation, the movable setting members (81, 82, 83) may be properly controlled to push the two ends (Aa)(Ab) of first base material (A) or the two ends (Ba)(Bb) of second base material (B) towards the first and second stationary setting members (73)(72).

Figure 9:
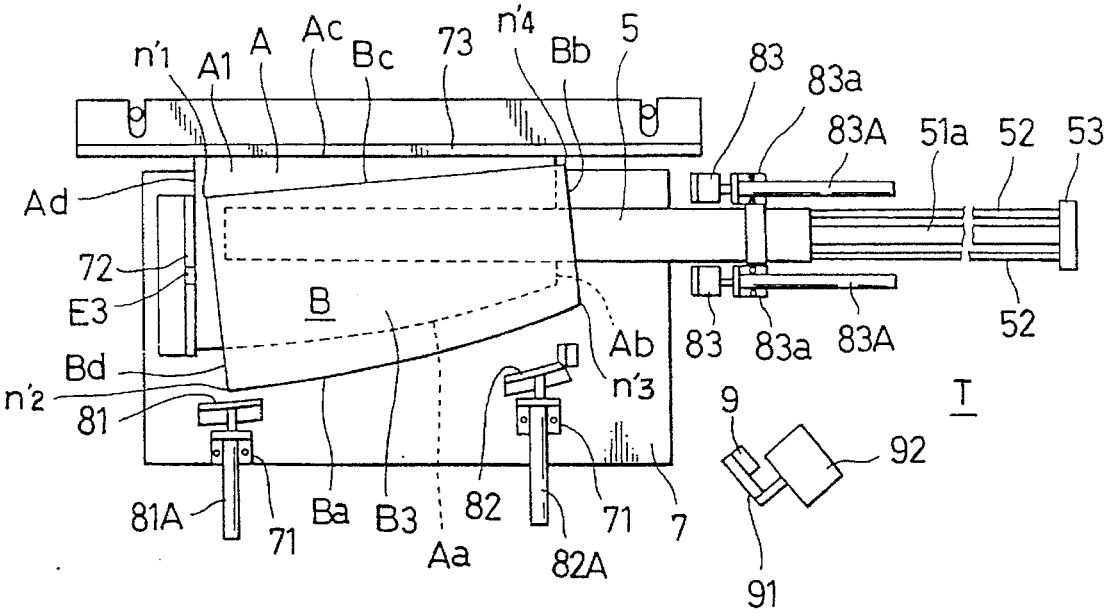
FIG. 9 is a schematic plan view of the setting mechanism, which shows a second base material to be roughly juxtaposed on the first base material set on the movable guide plate.
Figure 10:
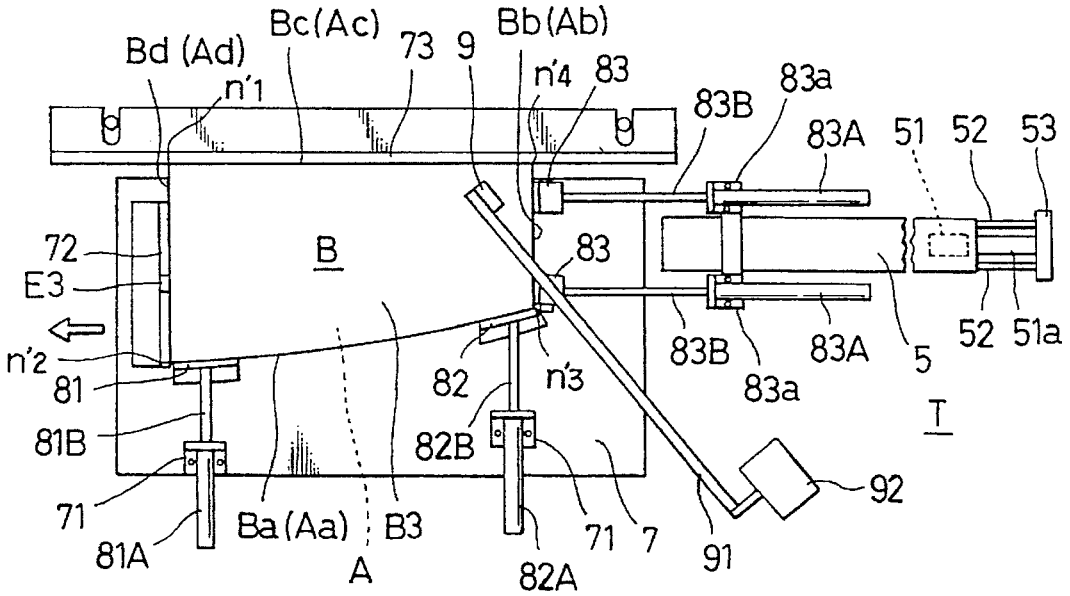
FIG. 10 is a schematic plan view of the setting mechanism, which shows the same to operate to set and retain the second base material upon the first base material.
Figure 11:
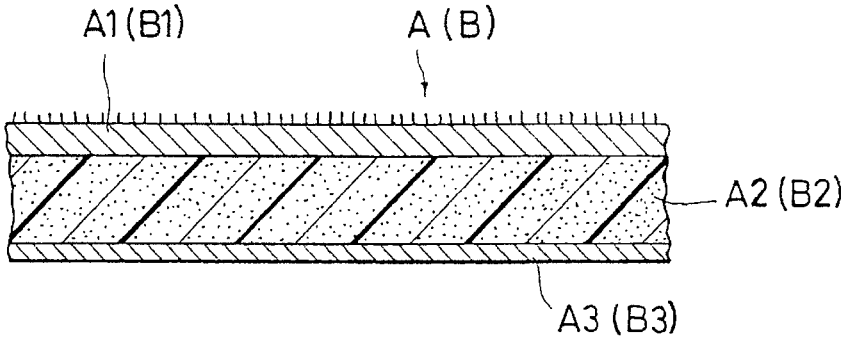
FIG. 11 is a partial cross-sectional view of either the first base material or the second material.

The retaining member (9) is fixed to the free end of an arm (91) connected to a rotary cylinder (92) fixed on the table (T). As shown in FIG. 2, normally, the retaining member (9) is positioned at a raised inoperative point above the setting mechanism (S), and operating the rotary cylinder (92), the retaining member (9) may be lowered down to the guide plate (7) to pressingly retain the second base material (B) against dislocation from the first base material (A), as can be seen in FIGS. 9 and 10, during the withdrawal of partition plate (5) from between the two materials (A)(B).

Though not shown, the setting mechanism (S) includes a computerized control unit for actuating its constituent elements stated above in cooperation with the supplying mechanism (D) to effect all required operations for supplying and setting the first and second base materials (A)(B), as will be described below, according to a program stored in memory of computer.

Now, a specific description will be made of operations of the above-constructed system hereinafter.

At first, the robot-hand unit (D1) is moved along the first tubular bar member (10A) towards the second moving block member (11) positioned above the first storage booth (6A). When the first moving block member (1) of the robot-hand unit (D1) is engaged with the engagement portion (11*a*) of that second moving block member (11) as indicated by the one-dot chain line in FIG. 1, the sensor (El) detects the robot-hand unit (D1) and sends a signal to a computer (not shown), which actuates the vertical cylinder (2) to extend its cylinder rod (2A) downwardly, causing the body of unit (D1) to be lowered towards the first base materials (A) piled up in the first storage booth (6A), shown in FIG. 3. Then, upon both two elastic members (R) of pressing devices (21) being contacted with the top cover layer (A1) of uppermost one of the first base materials (A), the cylinder rod (2A) of cylinder (2) is further extended to lower the body of robot unit (D1) to the degree that the respective sets of needles (31) of two catching devices (3) is pressingly contacted with the uppermost first base material (A), as indicated by the arrow ① in FIG. 4. At this moment, the photosensor (45) detects the uppermost first base material (A) and sends a signal to a computer (not shown) which stops the operation of cylinder (2) and then actuates both two horizontal cylinders (33)(33) to extend their respective cylinder rods (33A) (33A) outwardly in a direction opposite to each other, causing both paired catching members (32) and needles (31) to be moved away from each other, as indicated by the arrow ② in FIG. 4, so that the needles (31) deeply bite the fuzzy surface of uppermost first base material (A). Thus, the base material (A) is securely caught by the two catching members (32)(32).

Figure 6:
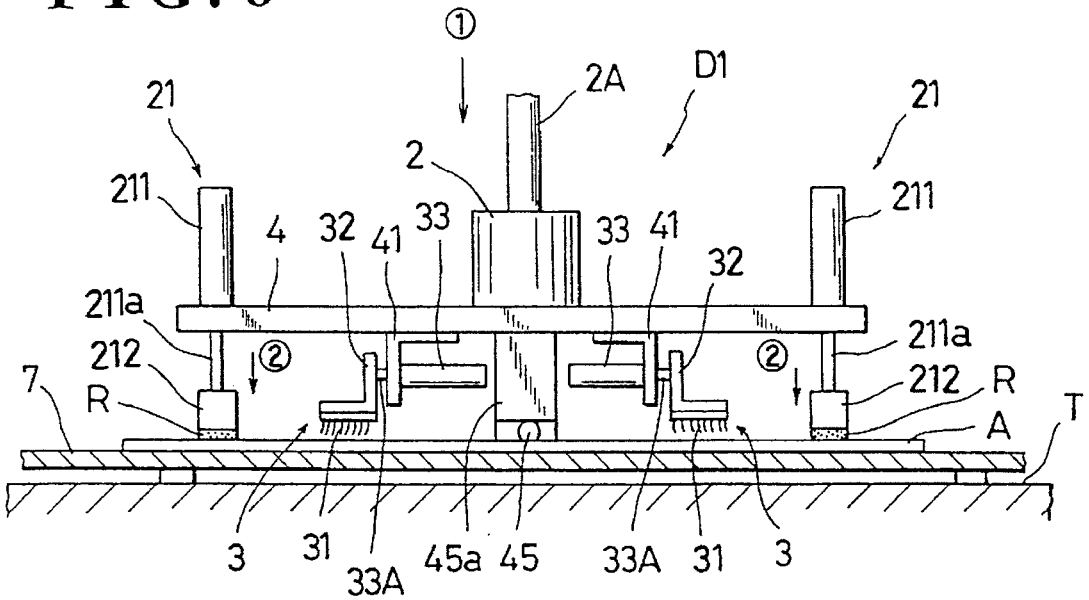
FIG. 6 is a schematic view of the robot-hand unit, showing explanatorily the same to be transferred together with the first base material to a movable guide plate, and place the first base material thereon.

Next, as indicated by the arrow in FIG. 5, after both two pressing members (212)(212) have been raised out of contact with the base material (A) by actuation of the respective cylinders (211) (211), the vertical cylinder (2) is operated to raise the body of robot unit (D1), bringing upwardly the base material (A) secured by the catching members (31) from another uppermost base material (A'). Thereafter, the robot unit (D1) is transferred by the first moving block member (1) along the first tubular guide member (10A) to the movable guide plate (7) at the setting mechanism (S). When the robot unit (D1) reaches a given setting point at the guide plate (7), the third sensor (E3) detects it and sends a signal to the not-shown computer which actuates the vertical cylinder (2) to lower the robot-hand unit (D1) toward the movable guide plate (7), as indicated by arrow ① in FIG. 6. Upon the first base material (A) contacting the guide plate (7), the vertical cylinder (2) is stopped and the two pressing cylinders (211) are operated to lower their respective pressing members (212) downwardly, as indicated by arrow ②, thereby pressingly retaining the base material (A) on the guide plate (7). Under this state, the paired horizontal cylinders (33) are actuated to retract the two catching members (32) toward each other to release their respective catching needles (31) from the state of piercingly engaging the upper surface of base material (A), as in FIG. 6. Thereafter, with the vertical cylinder (2) operated to raise the robot unit (D1) away from the guide plate (7), the first base material (A) is left and placed, in a random or rough way, upon that guide plate (7), as shown in FIG. 7.

Then, the first and second movable setting members (81)(82) and third movable setting members (83) are moved towards the curved lateral end (Aa) and upper rectilinear end (Ab) of first base material (A), respectively, through actuation of the cylinders (81A)(82A)(83A), so as to set in place the base material (A) on the guide plate (7) as shown in FIG. 8. Namely, the base material (A) is repositioned by those setting members (81)(82)(83) from its roughly placed state, such that the vertical rectilinear end (Ac) thereof is brought to abutment against the first stationary setting member (73) by the first and second movable setting members (81)(82) being moved thereto, while at the same time, the lower rectilinear end (Ad) thereof is abutted against the second stationary setting member (72) by the paired third setting members (83) being moved thereto, whereby the first corner (n1) of base material (A) is set in place between the first and second stationary setting members (73)(72), to initially settle the base material (A) at a given setting point on the guide plate (7). Also, other second, third and fourth corners (n2)(n3)(n4) of same base material (A) are embracingly set in that point by the conjunctive movements of the four movable setting members (81, 82, 83) towards the two stationary setting members (72)(73). In this way, a four-side enclosure arrangement is established to circumscribe and retain the four end sides of base material (A) against dislocation from the setting point, as shown in FIG. 8.

Thereafter, as in FIG. 8, the partition plate (5) is extended over the thus-set first base material (A) in a slight contact thereupon, along the length-wise direction thereof, by operation of the associated drive element (51).

At the completion of such setting of first base material (A), all the movable setting members (81, 82, 83) are retracted away from the first base material (A) to their respective inoperative positions as in FIG. 7, and the robot-hand unit (D1) is transferred to the second moving block member (11). The unit (D1) is moved by that block member (11) along the second tubular bar member (10B) toward the second storage booth (6B), as indicated by the one-dot and two-dot chain lines in FIG. 1. When the robot-hand unit (D1) reaches the second storage booth (6B), the second sensor (E2) detects it and sends a signal to the not shown computer.

In this case also, likewise as described above for the first base material (A) in FIGS. 3 to 6, under the computerized control, the robot-hand unit (D1) is lowered by actuation of the vertical cylinder (2) towards the second base materials (B) piled up in the second booth (6B), and subjected to all the same operations as in FIGS. 3 to 6 to catch the uppermost one of the second base materials (B). Thus, a further explanation is deleted about this catching processes, for the sake of simplicity in description.

It is noted here that, as opposed to the first base materials (A) in the first booth (6A), the second base materials (B) are so piled up in the second booth (6B) that each of them is turned upside down to expose its back wadding layer surface (B3) as indicated in FIG. 1. Hence, such back wadding layer surface (B3) is piercingly engaged and caught by the catching needles (31) in operation of the catching devices (3).

Then, subsequent to the uppermost second base material (B) having been caught by the catching devices (3) in the same way as shown in FIG. 5, the robot-hand unit (D1) travels along the second and first tubular members (10B) (10A) towards the guide plate (7) under computerized control through detections of the first and third sensors (E1)(E3). Upon arrival of the unit (D1) at the setting point above the guide plate (7) on which the first base material (A) is set, the vertical cylinder (2) is actuated to lower the unit (D1) toward the guide plate (7), until the second base material (B) is juxtaposed upon both first base material (B) and partition plate (5). Then, the catching needles (31) are released from the state of engaging the back surface (B3) of second base material (B), with the pressing members (212) being pressed against the juxtaposed second and first base materials (B)(A), likewise as in FIG. 6. Thereafter, the robot-hand unit (D1) is raised away from the guide plate (7), on which those two base plates (A)(B) are juxtaposed together but substantially separated from each other by the partition plate (5). At this stage, as shown in FIG. 9, the second base material (B) is left randomly or roughly relative to the neatly set first base material (A). Consequently, in the same manner as done for setting the first base material (A), all the first, second and third movable setting members (81)(82)(83) are moved toward such roughly placed second base material (B), through operations of their associated cylinders (81A)(82A)(83A), to abut the two rectilinear ends (Bc)(Bd) of second base material (A) against the first and second stationary setting members (73)(72), respectively. This results in setting the first corner (n'1) of base material (B) in place between the first and second stationary setting members (73)(72), to initially settle the base material (B) at a given setting point on the guide plate (7). Also, other second, third and fourth corners (n'2)(n'3)(n'4) of same base material (B) are embracingly set in that point by the conjunctive movements of the four movable setting members (81, 82, 83) towards the two stationary setting members (72)(73). Accordingly, a four-side enclosure arrangement is established as well for this second base material (B), whereby its four end sides are substantially circumscribed and retained against dislocation from the first base material (A), as can be seen from FIG. 10.

Therefore, both first and second base materials (A)(B) are neatly juxtaposed with each other and set at a predetermined setting point on the guide plate (7), with their respective four ends (Aa,Ba)(Ab,Bb)(Ac,Bc)(Ad,Bd) being registered precisely with one another. For that purpose, the height-wise width of all the setting members (73, 72, 81, 82, 83) should be greater than that of the two juxtaposed base materials (A)(B) enough to receive all their four ends (Aa,Ba)(Ab,Bb)(Ac,Bc)(Ad,Bd).

It is appreciated in this process that the partition plate (5), by the reason of its slippery surfaces, serves to permit the second base material (B) to be easily moved thereon, relative to the first base material (A), by the movable setting members (81, 82, 83).

Thereafter, as understandable in FIG. 10, the retaining member (9) is displaced by operation of the rotary cylinder (92) in the downward direction from the raised inoperative position (see FIG. 2) so as to pressingly retain a local part of the second base material (B) juxtaposed on the first base material (B). This insures to prevent the second base material (B) against dislocation relative to the first base material (A) due to the withdrawal of partition plate (5).

With both base materials (A)(B) thus retained by the retaining member (9), the partition plate (5) is withdrawn from therebetween by operation of the associated drive element (5).

Next, the third movable setting members (83) and the retaining member (9) are returned to their respective inoperative positions, after which, the guide plate (7) is moved along the three guide grooves (111)(112)(113) towards the sewing machine (M), with both first and second base materials (A)(B) set neatly thereon. Accordingly, in particular, the mutually registered rectilinear lateral ends (Ac)(Bc) of juxtaposed base materials (A)(B), which project from one lateral side of guide plate (7), is fed towards the sewing point of the sewing machine (M), as can be seen in FIG. 1, whereupon the two base materials (A)(B) are subject to sewing along their rectilinear lateral end portions (Ac)(Bc). The resulting sewn product is shown in FIGS. 12 and 13: Namely, after the two base materials (A)(B) are sewn together by the sewing machine (M) and taken out from the guide plate (7), they are folded outwardly along the line (Y) and expanded symmetrically relative to the seam (SM), to thereby provide one sheet of surface covering member for covering a seat, as in FIG. 12. In this respect, since the turned-over second base material (B) has been juxtaposed with the first base material (A), with the top cover layer (B1) of the former (B) laying on the top cover layer (A1) of the latter (A), the symmetrically expanded state of the two base materials (A)(B) results in their top cover layers (A1)(B1) expanding on the same plane, as in FIG. 12.

In accordance with the present invention, therefore, the two separate base materials (A)(B) are automatically supplied by the supplying mechanism (D) from their respective storage booths (6A)(6B) to the movable guide plate (7) and further automatically set by the setting mechanism (S) at a given point on that guide plate (7) in a neatly juxtaposed manner, so that the base materials (A)(B) are ready to be sewn together by the sewing machine (M) and there is eliminated the hitherto troublesome manual steps for an operator to supply and set the two base materials (A)(B) for sewing by the sewing machine.

While having described the present invention thus far, it should be understood that the invention is not limited to the illustrated embodiments, but any other modifications, replacements and additions may be structurally applied thereto without departing from the scope of the appended claims.

What is claimed is:

1. A system for supplying and setting two separate base materials in a condition to be sewn by a sewing machine, said system comprising:

a table adapted to mount said sewing machine;

a movable guide means which is slidably mounted on said table;

a supplying mechanism for supplying said two separate base materials to said movable guide means, said supplying mechanism being provided at said table and including:

a first storage means in which a plurality of one of said two base materials are stored in a piled-up manner;

a second storage means in which a plurality of another of said two base materials are stored in a piled-up manner; and a robot-hand means displaceable between a selected one of said first and second storage means and said movable guide means, said robot-hand means including a pair of catching means for releasably engaging and catching a selected one of said two base materials and a pair of pressing means for applying a pressure to said selected one of said two base materials; and a setting mechanism for setting said two separate base materials and juxtaposing them together at a predetermined position upon said movable guide means, said setting mechanism including:

a setting means arranged at and adjacent said movable guide means, said setting means being operable to act on said two base materials which are supplied to and juxtaposed on said movable guide means by means of said supplying mechanism, such that both said two separate base materials may be neatly set at said predetermined position on said movable guide means;

a partition means extendable over said movable guide means and retractable therefrom, an arrangement of said partition means being such as to partition one of said two separate base materials which is directly placed by said supplying mechanism on said movable guide means, from another of said two separate base materials which is to be juxtaposed on the thus-placed one of said two base materials by said supplying mechanism; and a retaining means for pressingly retaining said another of said two separate base materials which is juxtaposed on and partitioned via said partition means, from said another of said two separate base materials.

2. The system as defined in claim 1, wherein said robot-hand means includes: a horizontal frame, on which are provided said pair of catching means and said pair of pressing means; and a vertical cylinder means provided on said horizontal frame, said vertical cylinder being operable to cause vertical movement of said robot-hand means per se with respect to said table.

3. The system as defined in claim 1, wherein said pair of catching means each includes plural needle means to be piercingly engaged with a surface of either of said two separate base materials, wherein said robot-hand means includes a pair of horizontal cylinders each being operable to cause the respective said pair of catching means to be moved in a horizontal direction toward and away from each other, and wherein both said pair of catching means and two sets of said plural needle means respectively thereof are disposed between said pair of pressing means.

4. The system as defined in claim 3, wherein said two sets of said plural needle means are inclined in a direction opposite to each other.

5. The system as defined in claim 1, wherein said supplying mechanism includes a transfer means for transferring said robot-hand means to either said first and second storage means or said movable guide means.

6. The system as defined in claim 1, wherein said robot-hand means includes a sensor means for detecting an uppermost one of either of said plural first and second base materials respectively stored in said first and second storage means.

7. The system as defined in claim 1, wherein said movable guide means is movable along guide grooves formed on the table in a direction towards a sewing portion of said sewing machine.

8. The system as defined in claim 1, wherein said setting means comprises a stationary setting means and movable setting means, wherein both said stationary and movable setting means are disposed at said table and movable guide means such as to surround said predetermined position on said movable guide means, and wherein said movable setting means includes an actuator means for causing the same movable setting means per se to be moved in a direction toward and away from said stationary setting means so as to set said two separate base materials at said predetermined position on said movable guide means.

9. The system as defined in claim 8, wherein said stationary setting means comprises a first stationary setting member provided on said table and a second stationary setting member provided on said movable guide means, wherein said movable setting means comprises a first movable setting member movably provided on said movable guide means and a second movable setting member movably provided on said table, with such an arrangement that said first and second movable setting members are disposed in opposedly facing relation with said first and second stationary setting members, respectively, and wherein said actuator means comprises a first cylinder means for causing said first movable setting member to move toward and away from said first stationary setting member and a second cylinder means for causing said second movable setting member to move toward and away from said second stationary setting member, so that, by operation of said first and second cylinder means, said two separate base materials may be set within said first and second movable setting members as well as said first and second stationary setting members and thereby brought to said predetermined position.

10. The system as defined in claim 9, wherein said two separate base materials are identical in shape to each other, and have their respective common ends to be sewn together, wherein all said two stationary setting members and two movable setting members are so arranged that they will cooperate with one another to provide setting surfaces generally conforming to an outer contour of said two identical base materials, by operating said first and second cylinder means, and wherein one of said first and second stationary setting members is arranged to receive and set said common ends of said two separate base materials relative to said predetermined position.

11. The system as defined in claim 9, wherein there are arranged a pair of said first movable setting members and a pair of said first cylinder means, on said movable guide means, such that one of said pair of first movable setting members may be moved, by operating one of said pair of first cylinder means, in a direction towards said second stationary setting member so as to cooperate therewith to circumscribe and set one corner each of said two separate base materials, whereas another of said pair of first movable setting members may be moved, by operating another of said pair of first cylinder means, in a direction towards a point for receiving another corner each of said two separate base materials, and that said second movable setting member may be moved by operation of said second cylinder means towards said point so as to cooperate with said another of said pair of first movable setting members to circumscribe and set said another corner each of said two separate base materials.

12. The system as defined in claim 9, wherein said first stationary setting member is located on said table in such a manner as to extend along one lateral side of said movable guide means, with a clearance given therebetween, and extend to a point in proximity of said sewing machine, and wherein said second stationary setting member is located on said movable guide means such as to extend generally at a right angle relative to said first stationary setting member.

13. The system as defined in claim 1, wherein said partition means comprises a partition plate and a cylinder means for extending and retracting said partition plate in a direction toward and away from said movable guide means, whereby said one of said two separate base materials directly placed on said movable guide means may be partitioned by said partition plate from said another of said two separate base materials which is to be juxtaposed on the thus-placed one of said two separate base materials.

14. The system as defined in claim 13, wherein said partition plate has slippery surfaces and is so disposed as to extend on a line above said movable guide means at a distance slightly greater than a thickness of said one of said two separate base materials directly placed on said movable guide means.

15. The system as defined in claim 1, wherein said retaining means comprises a rotary cylinder means, an arm connected at the base end thereof to said rotary cylinder means, and a retaining member fixed to a free end of said arm, and wherein by operation of said rotary cylinder means, said retaining member may be displaced between a raised inoperative position above said movable guide means and a lowered operative position where the retaining member pressingly retains said another of said two separate base materials which is juxtaposed on said one of said two separate base materials.

16. The system as defined in claim 1, wherein each of said two separate base materials is of a three-layer lamination structure comprising a top cover layer with a fuzzy surface, a foam wadding layer, and a back wadding cover layer, in this order.

17. The system as defined in claim 1, wherein said two separate base materials are identical in shape to each other, and have their respective common ends to be sewn together, wherein each of said two separate base materials is of a three-layer lamination structure comprising a top cover layer with a fuzzy surface, a foam wadding layer, and a back wadding cover layer, in this order, wherein one of said two identical separate base materials is stored in a plural form within said first storage means, with the top cover layer thereof exposed upwardly, while by contrast, another of said two identical separate base materials is turned over and stored in a plural from, with the back wadding cover layer thereof exposed upwardly, within said second storage means, wherein said setting means comprises a stationary setting means and movable setting means, wherein said stationary and movable setting means are so arranged that, when in operation, they cooperate with each other to provide setting surfaces generally conforming to an outer contour of said two identical base materials, and wherein said stationary setting members is further so arranged to receive and set said common ends of said two base materials relative to said predetermined position.

* * * * *